US007976228B2

(12) United States Patent
Lambert

(10) Patent No.: US 7,976,228 B2
(45) Date of Patent: Jul. 12, 2011

(54) MIRROR

(76) Inventor: Hugh Lambert, Dorset (GB)

( * ) Notice: Subject to any disclaimer, the term of this patent is extended or adjusted under 35 U.S.C. 154(b) by 116 days.

(21) Appl. No.: 12/270,077

(22) Filed: Nov. 13, 2008

(65) Prior Publication Data

US 2009/0136227 A1 May 28, 2009

(30) Foreign Application Priority Data

Nov. 15, 2007 (GB) ..... 0722422.3

(51) Int. Cl.
*G03B 17/00* (2006.01)
*G02B 7/182* (2006.01)
*A47G 1/16* (2006.01)

(52) U.S. Cl. ... 396/428; 359/871; 248/466; 248/346.06; 248/346.2

(58) Field of Classification Search ..... 396/419, 396/428, 312, 176, 182, 199, 376; 248/346.06, 248/346.2, 466, 549, 634, 636; 359/871; 132/291, 296, 301, 304, 305, 316
See application file for complete search history.

(56) References Cited

U.S. PATENT DOCUMENTS

| | | | | |
|---|---|---|---|---|
| 2,219,974 | A | 10/1940 | Bellow | |
| 3,439,598 | A * | 4/1969 | Weitzner et al. | 396/312 |
| 4,192,329 | A | 3/1980 | Swearingen | |
| 4,346,895 | A | 8/1982 | Brownlee | |
| 4,490,029 | A * | 12/1984 | Tanaka et al. | 396/317 |
| 4,501,401 | A | 2/1985 | Conee | |
| 5,350,147 | A * | 9/1994 | Paganus | 248/346.2 |
| 6,315,120 | B1 | 11/2001 | Tally et al. | |
| 6,536,960 | B2 * | 3/2003 | Kubo et al. | 396/355 |
| 6,640,813 | B2 | 11/2003 | Raisner et al. | |
| 2002/0196333 | A1 | 12/2002 | Gorischek | |
| 2003/0106563 | A1 | 6/2003 | Raisner et al. | |
| 2008/0203262 | A1 * | 8/2008 | Sparks | 248/346.01 |

* cited by examiner

*Primary Examiner* — W. B. Perkey
(74) *Attorney, Agent, or Firm* — Michael J. Colitz, III; GrayRobinson, P.A.

(57) ABSTRACT

A device for hands-free self-examination is provided comprising a viewing component having a mirror which is attached to a compliant receptacle. The receptacle being configured to receive filler material thereby enabling the device to be positioned on an irregular surface such that it substantially conforms thereto and enabling the mirror to be manipulated to any orientation.

6 Claims, 2 Drawing Sheets

MIRROR

FOREIGN PRIORITY

This application claims priority to U.K. application GB0722422.3 filed on Nov. 15, 2007. The contents of this application are incorporated fully herein.

This invention relates to apparatus for undertaking self-examination. In particular, in an environment having only irregular surfaces upon which a conventional mirror having a conventional stand could not be placed.

There are many circumstances where a user of a mirror is unable to hold the mirror in one hand, as both hands are required to perform the operation/task that is to be carried out, for example shaving. However, in the majority of these circumstances, a mirror attached to the wall provides adequate visibility of the area to be inspected. In order to increase the versatility of wall mounted mirrors, they may be fitted with a pivoting device, whereby the mirror can be tilted or otherwise manipulated to alter the orientation of a reflective surface of the mirror. Alternatively, it is known to mount a mirror on a flexible stem, the stem being connected to a base which is then itself mounted on a smooth flat surface. The mirror of this device can then be orientated by manipulating the flexible stem until it faces an appropriate direction, this permitting self-inspection.

It is also known to use a similarly flexible stem in combination with a clip whereby the clip can be attached to the edge of a table, a rail or other protruding structure.

There remain, however, circumstances when none of these known configurations can be used. For example when the only flat surface is the floor and this is too far away from where the user wishes to use the device. Alternatively, there may be no protruding surfaces to which a clip could be connected. Furthermore, the aforementioned devices could be regarded as somewhat cumbersome and it may be desirable to provide a device which is more compact and potentially easier to pack than would be a device having a flexible stem.

According to a first aspect, the present invention provides a device for hands-free self-examination comprising:

a viewing component having a mirror; and a compliant receptacle attached to the viewing component, the receptacle being configured to receive compliant filler material thereby enabling the mirror to be manipulated to any orientation and enabling the device to be positioned on an irregular surface and substantially conform thereto.

By providing a receptacle for receiving compliant filler material e.g. particulate matter, as a support structure for the mirror, the device can be placed on a multitude of irregular surfaces for example a bed, a grassy slope, a beach or the arm of an armchair amongst others and the mirror can be stably orientated to ease use thereof. Furthermore, no hinges or other positioning components which may deteriorate over time are required.

The device may comprise a frame within which the mirror is mounted. The device may comprise lighting means. The lighting means may, for example, comprise one or more LED lights. The lighting means may be located in the frame.

The device may comprise audio means. The audio means may be configured to play an audio file to a user of the device. The audio means may comprise recording means for recording a user of the device.

The device may comprise camera means and the mirror may be a one way mirror.

The receptacle may contain filler material, for example, sand, soil, polystyrene beads, dried pulses, metal balls or pebbles. The filler material may comprise objects having first and second respective dimensions and/or objects having first and second densities.

Preferred features of the present invention will now be described, by way of example only, with reference to the accompanying drawings, in which.

Figure 1:
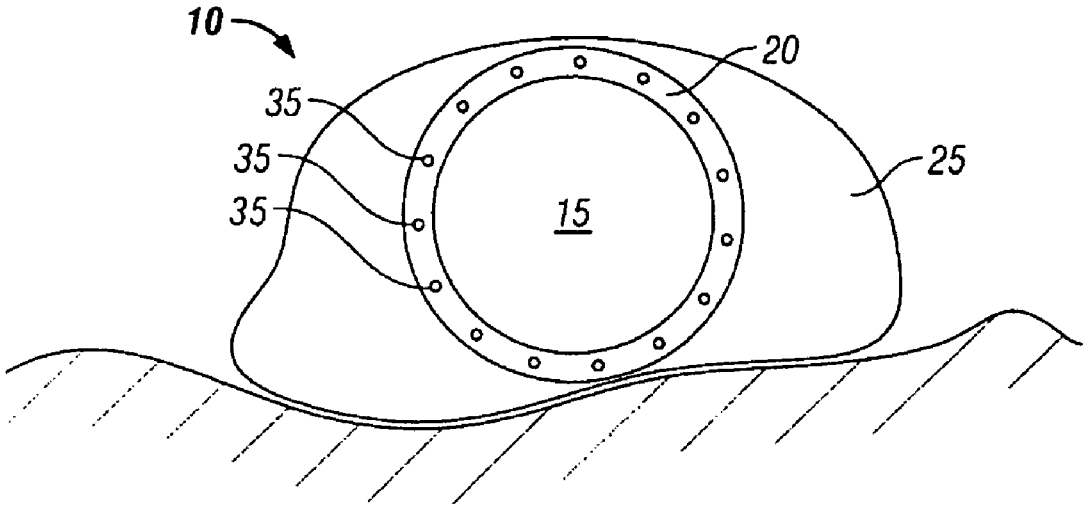
FIG. 1 illustrates a mirror having a beanbag support.

FIG. 1 illustrates a device for self-examination, in other words, apparatus for use by a user who may wish to view part of their body whilst having both hands free to perform an activity/operation other than holding the mirror. In particular, the device is suited to use in an armchair or on the bed, when changing a dressing in a difficult to view location such as the lower back or the back of a leg, waxing or applying depilatory cream to the bikini line area or inserting suppositories or pessaries. The device can be used in bed during sex to improve the users' view of themselves.

The device 10 comprises a viewing component having a reflective surface such as a mirror 15. In FIG. 1, the mirror 15 is mounted within a frame 20. A receptacle 25, made from a compliant material such as fabric, is attached to the frame 20 around a peripheral extreme thereof. The mirror 15 could be bonded to a surface of the receptacle 25. In either embodiment, the receptacle 25 represents an extension or continuation of the reflective surface, such that a unitary device, having no moving parts is provided.

The receptacle 25 is configured to receive a filler material 30. The filler material 30 is preferably granular and may comprise beads (e.g. polystyrene beads), sand, soil, dried pulses, ball bearings, high density plastic beads or any other small scale particulate matter.

Figure 2:
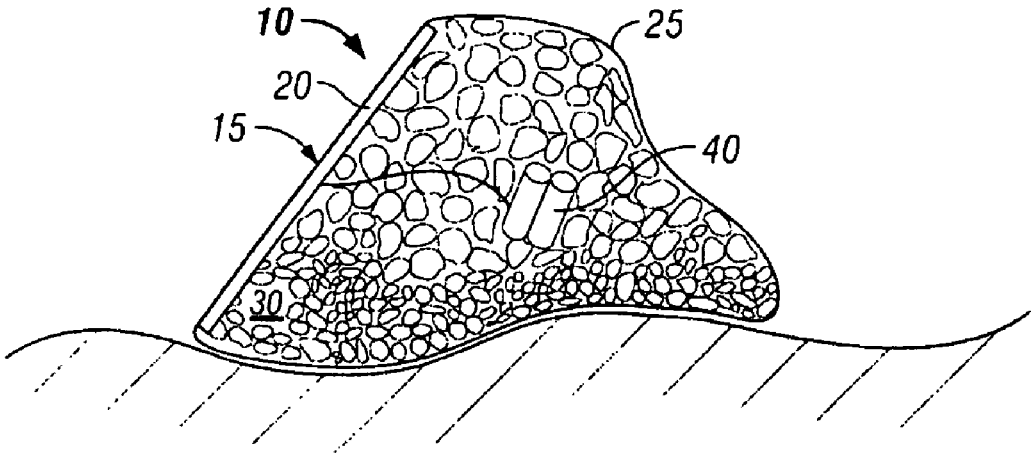
FIG. 2 illustrates a first embodiment of some internal details of the device of FIG. 1.
Figure 3:
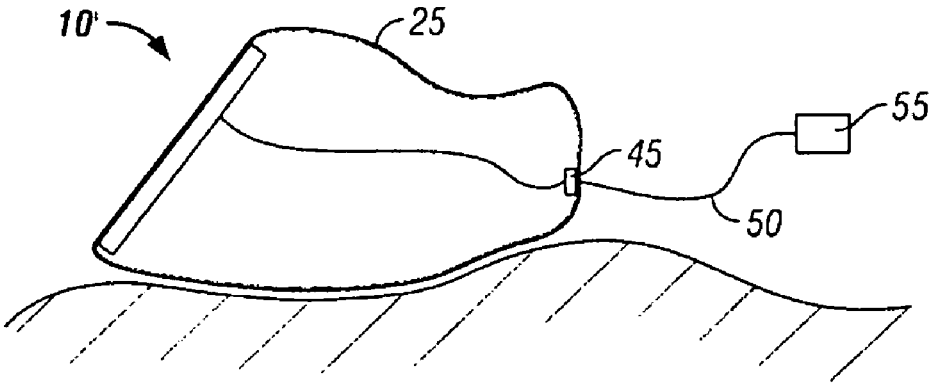
FIG. 3 illustrates a second embodiment of some internal details of the device of FIG. 1.

As illustrated in this example, the frame 20 may comprise lighting means 35. For example, a number of LED lights may be embedded within the frame 20. As shown in FIG. 2, a power source 40 (eg a battery) for powering the lighting means 35 may be provided within the receptacle of 25 of the device 10 and may be embedded within the filler material 30 located within the receptacle 25. Alternatively, as shown in FIG. 3, the device 10' may comprise a socket 45 for receiving a cable 50 through which the device may receive power from an external source 55.

The frame 20 may comprise a light defusing material, covering the lighting means 35, so that a more defused light is provided by the device 10.

The compliant material of receptacle 25 containing the granular filler material 30 enables the device 10 to be positioned on any uneven, irregular surface. The device 10 conforms to the uneven surface thus providing a stable support for the mirror 15. As the receptacle 25 is compliant, the mirror 15 can readily be manipulated by the user to adopt any desired orientation thereby providing an improved view in the mirror. Furthermore, the mirror 15 can be positioned in close proximity to the object or body part to be viewed.

Where the device 10 is to be used outside or on the move, the device 10 can be transported without the filler material 30 so that the device packs up very compactly. When the device 10 is required, the receptacle 25 can be filled with sand, soil, pebbles or gravel (which could be sourced locally) to permit operation thereof. The device 10 is, therefore, highly portable and versatile.

The device 10 may comprise audio means (not shown), whereby instructions to the user for carrying out some chosen application can be provided. Furthermore, a small camera, optionally having a recording device may be incorporated within the receptacle 25 behind the mirror 15, which in this example could be a one-way mirror. This embodiment enables the monitoring of a child in a nursery or, indeed, facilitates covert filming, for example, during sex.

The mirror 15 may comprise a flat, concave or convex glazed mirror. Alternatively, the mirror 15 may comprise stainless steel or a plastics material such as acrylic. The receptacle 25 may comprise a fireproof material and/or a wipeable material. The receptacle 25 may be configured such that it detaches from the mirror 15 and/or frame 20 and may, in turn, be washable.

The lighting means 35 may be controllable so that the brightness of the light emitted therefrom can be reduced or increased as appropriate for the particular application. A switch may be provided on the frame to effect this change in brightness. Alternatively, the frame or the mirror may comprise a touch sensitive sensor configured to receive signals provided from contact with the user and to modify the brightness dependent on the received signals.

The filler material 30 may comprise a mixture of materials as illustrated in FIG. 2. Smaller diameter, dense beads made from, for example, lead may be provided in combination with larger less dense beads made from, for example, polystyrene or wood. In so doing, the stability of the device 10 can be enhanced as the smaller, denser filler material migrates to the bottom of the receptacle 25 under the action of gravity and/or application of some agitation by the user and therefore conforms to the uneven surface in a more efficient manner. Meanwhile, the lighter, less dense, materials pass to an upper portion of the receptacle 25 so that the overall weight of the device 10 does not become too burdensome. In this way, support for the mirror 15 is maintained as the receptacle 25 is completely filled and so the mirror 15 can be positioned at any desired orientation.

The device may have a number of applications outside, such as working upon a stationary vehicle that is located upon uneven ground or for use by a mother with a number of children playing on a beach, the mother could improve her field of vision and effectively have "eyes in the back of her head" whilst reading her book. The device is particularly suited to camping as the user may position the mirror downwards and use the filled receptacle as a pillow. When a night light is required in the middle of the night the device can simply be turned around so that the mirror and lighting means 35 are exposed. Such a multi-functional device is particularly desirable in a camping accessory.

Figure 4:
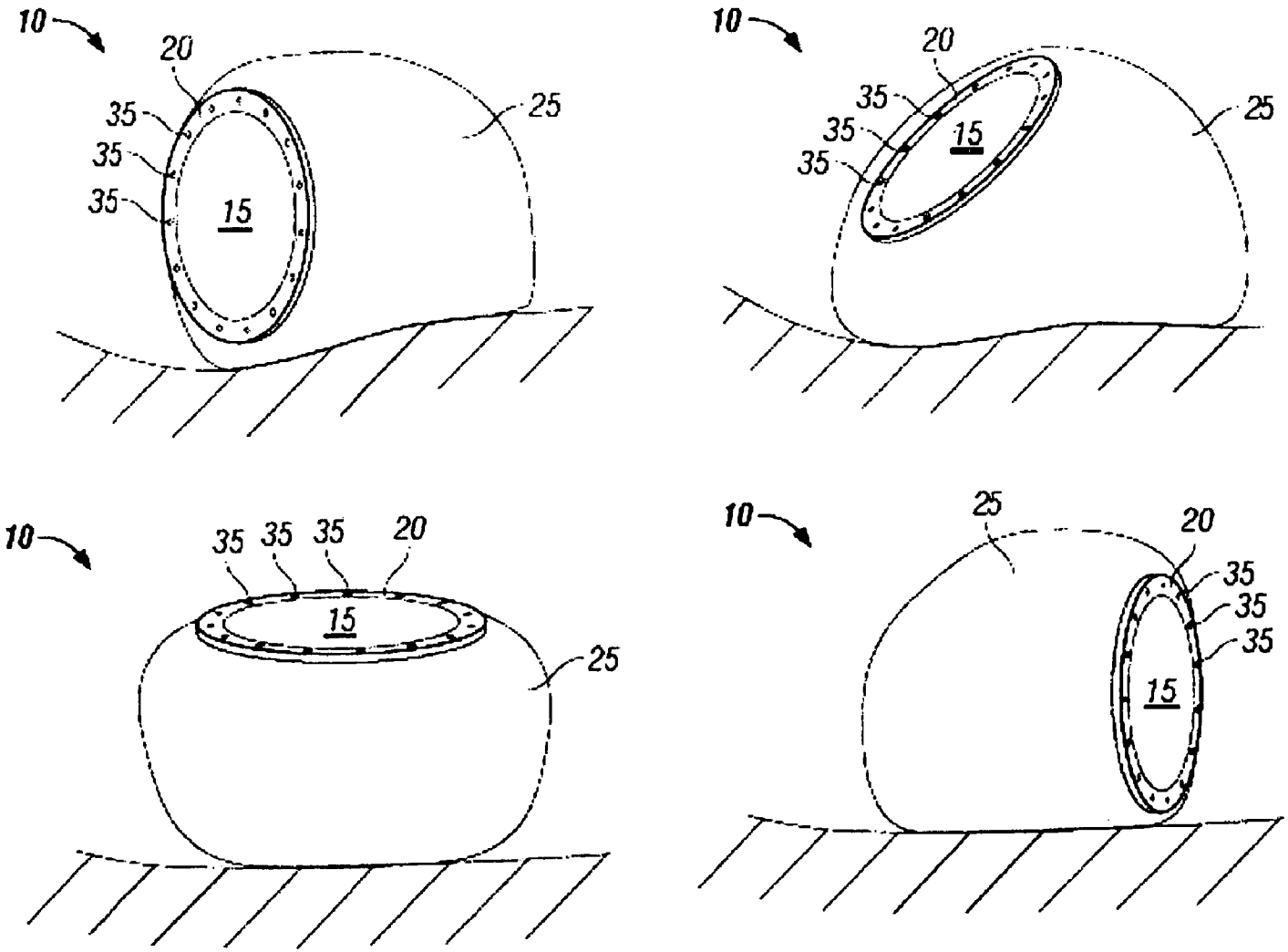
FIG. 4 illustrates the device in use.

In summary a free standing, self supporting bed mirror is provided whereby the receptacle 25 or bean bag provides a very stable yet portable device having no hard edges which can, therefore, be used in the confines or a tent or bed and the user cannot inadvertently harm themselves on any hard edges. The device does not comprise any hinges or gimbals which may require fine adjustment, the device is, therefore, appropriate for use by a user lacking fine motor control without the ability to make such adjustments. The device can readily be orientated to any aspect as exemplified in FIG. 4.

The device may be positioned in very close proximity to the part of the body or object to be viewed and, as such, proves to be a very versatile device.

The invention claimed is:

1. A unitary device for hands-free self-examination comprising:

a viewing component having a mirror with a periphery; and a compliant receptacle attached to the periphery of the viewing component, whereby the complaint receptacle represents a continuation of the viewing component, the receptacle being configured to receive compliant filler material, thereby enabling the mirror to be manipulated to any orientation and enabling the device to be positioned on an irregular surface such that it substantially conforms thereto;

the filler material comprising a mixture of first and second beads, the first beads being smaller and more dense than the second beads, whereby the first beads migrate to the bottom of the receptacle to conform to the irregular surface more efficiently.

2. A device according to claim 1, comprising a frame within which the mirror is mounted.

3. A device according to claim 1, comprising lighting means.

4. A device according to claim 3, wherein the lighting means comprises one or more LED lights.

5. A device according to claim 3, wherein the lighting means is located in the frame.

6. A device according to claim 1, wherein the mirror is a one way mirror.

* * * * *